US006598355B2

(12) United States Patent
Owens

(10) Patent No.: US 6,598,355 B2
(45) Date of Patent: Jul. 29, 2003

(54) ANTI-STACKING SYSTEM FOR OPERABLE WALLS

(75) Inventor: N. Douglas Owens, Lynn, IN (US)

(73) Assignee: Modernfold, Inc., New Castle, IN (US)

( * ) Notice: Subject to any disclaimer, the term of this patent is extended or adjusted under 35 U.S.C. 154(b) by 35 days.

(21) Appl. No.: 09/821,574

(22) Filed: Mar. 29, 2001

(65) Prior Publication Data

US 2001/0037613 A1 Nov. 8, 2001

Related U.S. Application Data

(60) Provisional application No. 60/194,540, filed on Apr. 4, 2000.

(51) Int. Cl.[7] ..... E04B 1/346

(52) U.S. Cl. ..... 52/71; 16/87 R; 160/199; 160/118; 160/193

(58) Field of Search ..... 52/64, 65, 71, 52/243.1, 238.1; 160/199, 206

(56) References Cited

U.S. PATENT DOCUMENTS 1,786,505 A * 12/1930 Phillips ..... 16/87 R
3,295,588 A * 1/1967 Gilson ..... 160/199
3,448,786 A * 6/1969 Edgerton, Jr. ..... 160/199
5,755,270 A * 5/1998 Knezevich et al. ..... 160/118
5,947,178 A * 9/1999 Patten ..... 160/193

* cited by examiner

*Primary Examiner*—Carl D. Friedman
*Assistant Examiner*—Steve Varner
(74) *Attorney, Agent, or Firm*—Baker & Daniels

(57) ABSTRACT

An anti-stacking system for an operable wall includes a guide rail mounted on or adjacent to the track so that the guide rail is engaged by panel orienting members attached to the trolley bolt. The guide rail may be mounted on the track or to the track suspending brackets. In a preferred embodiment, the guide rail is integral with the track. Panel orienting members that engage the guide rails are mounted to the bolts of the trolleys, which bolts in turn are fixed rotationally to the panels. At designated areas in the room, the track is free of the guide rail to allow stacking of the wall panels when not in use. In wall forming areas, the panel orienting members engage the guide rails so as to cause the trolley bolts, and thus the panels, to be properly rotated into a proper wall-forming arrangement and to remain in the wall forming arrangement until moved to a storage area.

32 Claims, 12 Drawing Sheets

ANTI-STACKING SYSTEM FOR OPERABLE WALLS

CROSS-REFERENCE TO RELATED APPLICATION

This application claims the benefit under 35 U.S.C. §119 (e) of co-pending U.S. Provisional Application No. 60/194,540, filed Apr. 4, 2000.

BACKGROUND OF THE INVENTION

The present invention pertains to operable walls movable to partition large rooms into smaller rooms, and, in particular, to a system for preventing panels from being stacked at inappropriate locations along the length of the operable wall track.

Operable walls or partitions, also known as moveable wall panel systems, find useful application in a variety of venues, such as classrooms, offices, convention facilities and hospitals. In these venues, the operable walls can be used to efficiently divide or compartmentalize interior space into a multitude of separate, smaller rooms. In particular, the operable wall panels are typically connected to trolleys that roll within an overhead track, and travel of the trolleys within the track allows the panels to be moved between a stacked arrangement in a storage location, and a wall-forming, extended arrangement in alignment with the overhead track.

One potential problem with operable walls can occur if the panels are not prevented from moving into a stacked arrangement along sections of the track other than the track storage location. When panels are in a stacked arrangement as opposed to being in a wall-like extended arrangement, the weight of the panels is more concentrated along the track. Because operable wall tracks typically are suspended from an overhead support structure via depending hanger brackets, unless stacking is prevented along a given section of the track, additional or larger hanger brackets are required for that track section to prevent the hanger brackets from being overloaded by the weight of the operable wall. This need for additional or larger brackets undesirably increases the cost of the operable wall, as well as makes installation more time consuming and therefore expensive.

Existing devices which function to limit stacking typically do so in the process of performing their primary intended function of flattening the wall panels as the panels are moved from a stacked, stored arrangement to an extended arrangement for use. These devices typically use guide rails that extend along the length of the track except proximate to the track location at which the panels are stored. These guide rails, which are mounted on the ceiling soffit and extend down into the room so as to flank one or more sides of the operable wall, frequently include flared ends at the panel insertion region that aid in initially flattening or straightening the panels and forcing the panels in between the guide rails. Laterally projecting guide or rub blocks installed on the sides of the wall panels cooperate with the guide rails to keep the panels flat as wall extension continues. Shortcomings of these types of guide rail designs are numerous, including that they and the rub blocks on the wall panel sides are visible and detract from the decor of the room in which they are installed, and that they often result in damage along the top edge portions of the panels which is visible to users.

Another type of existing guide rail system for operable walls includes one or more guide rails that extend down from the soffit at positions within the opposite side facades of the wall panels when extended. Upstanding guide members mounted to the top of the panel between the panel sides engage the guide rails. While these guide members and guide rails are hidden from view behind acoustical sweep seals when the operable wall is extended, the guide rails are readily visible when the wall is stacked. In addition, rollers that engage the sides of the panels to initially flatten the wall panels during wall extension such that the panel mounted guide members insert between the guide rails are always visible and detract from the aesthetics of the room.

Thus, it would be desirable to overcome these and other shortcomings of these prior devices.

SUMMARY OF THE INVENTION

The present invention provides an anti-stacking system for an operable wall which is hidden from the view of a person in a room in which the operable wall is installed. The anti-stacking system includes a guide rail adjacent to the track and extending substantially along the length of the track. A panel orienting member is mounted to the trolley bolt supporting wall panel and includes a biasing arm engaging the guide rail to prevent rotation of the panel to a stacking position at other than the storage location on the track. In one embodiment of the invention, the guide rail includes a guide flange having a flared end at the end of the guide flange adjacent to the storage area of the track. The guide flange has a flared end to allow a gradual transition of the panels from a wall arrangement to a stacking position as the panel orienting member contacts the flared end. In a preferred embodiment, the flared end includes a portion of the guide flange adjacent the storage section, which is bent out an outward angle relative to the track. In the most preferred embodiment, bend angle is between 20° and 30° relative to the guide flange.

In another embodiment of the invention, the guide rail includes a wedge mounted on the track adjacent to the storage section. The wedge has a ramped surface to engage the biasing arm to allow gradual transition of the panels from a wall arrangement position to the stacking position.

In yet another embodiment, the guide rail is integrally formed with the track.

In a preferred embodiment of the invention, the trolley bolt has a free end defining a slot and the biasing arm of the panel orienting member includes a first end section engaging the slot in the trolley bolt. The biasing arm also includes a circular bent section surrounding the free end of the trolley bolt and an end section that engages the guide rail to bias the panel member in a wall arrangement position. In a most preferred embodiment, a wear knob is attached to the end of the end section of the second end section of the bias arm to reduce friction with the guide rail.

In another version of the invention, the biasing arm has a center section engaging the slot of the trolley bolt and first and second end sections bent in opposite directions along the track. In this embodiment, each end section engages one of two guide rails on a track to bias panels in a wall arrangement position.

In another version of the invention, the biasing arm includes a pair of elongated vertically spaced plates. Each having a center section attached to a free end of the trolley bolt and a pair at opposite ends extending in opposite direction parallel to the width of the wall panel, the opposite ends of the pair plates defining a slot. An insert made of low friction material is receivable in each of the slots and contacts and engages a guide rail to prevent rotation of the wall panels to a stacking position.

In yet another version of the invention, the biasing arm includes a bar having a center section attached to the trolley bolt and a pair of opposite ends extending in opposite directions and angled in relation to the wall panel. The bar has a roller mounted at each end for engagement with a guide rail. The bar is sized so that the rollers are in close proximity to at least one guide rail of the wall panel is in a wall arrangement position.

One advantage of the present invention is that operable wall panels can be prevented from stacking at sections of the track deemed inappropriate, such as anywhere but the track end at which the panels are stored in a stacked arrangement.

Another advantage of the present invention is that it is not visible at any time within the room in which the operable wall is installed, and therefore does not detract from the aesthetics of the room.

Another advantage of the present invention is that it may be retrofitted on many existing operable walls.

Still another advantage of the present invention is that it is relatively inexpensive to manufacture and install.

Still another advantage of the present invention is that it may be configured to provide a resistance to panel rotation which is directly proportional to how much the panel has been rotated from an orientation in alignment with the track to an orientation transverse to the track.

BRIEF DESCRIPTION OF THE DRAWINGS

The above mentioned and other advantages and objects of this invention, and the manner of attaining them, will become more apparent and the invention itself will be better understood by reference to the following descriptions of embodiments of the invention taken in conjunction with the accompanying drawings, wherein.

Figure 1:
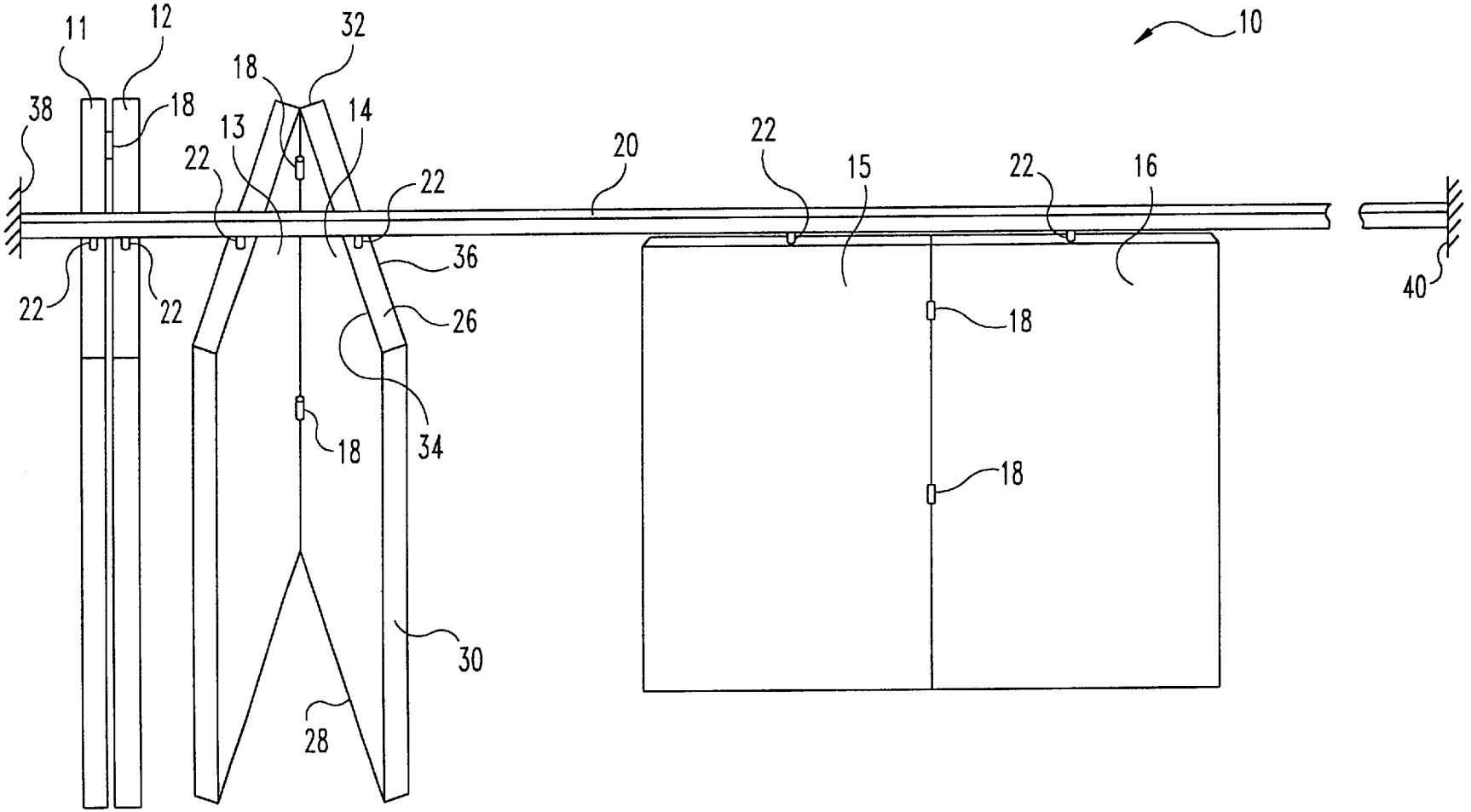
FIG. 1 is a diagrammatic perspective view of one embodiment of an operable wall, shown being moved from a fully stacked arrangement to an extended, wall-forming arrangement, with which the various embodiments of the anti-stacking system described herein may be employed.

Corresponding reference characters indicate corresponding parts throughout the several views. Although the drawings represent embodiments of the invention, the drawings are not necessarily to scale and certain features may be exaggerated or omitted in order to better illustrate and explain the present invention.

DESCRIPTION OF THE PREFERRED EMBODIMENTS

For the purposes of promoting an understanding of the principles of the invention, reference will now be made to the embodiments illustrated in the drawings and specific language will be used to describe the same. It will nevertheless be understood that no limitation of the scope of the invention is thereby intended. The inventions includes any alterations and further modifications in the illustrated devices and described methods and further applications of the principles of the invention which would normally occur to one skilled in the art to which the invention relates.

Referring now to FIG. 1, there is diagrammatically shown an operable wall, generally designated 10, which may be equipped with any of the panel anti-stacking systems of the present invention. Operable wall 10 is shown as a paired panel system including three pairs of wall panels suspended from an abstractly shown track 20. The operable wall typically would include more panels than the shown three pairs, but only such panels are shown to facilitate illustration and explanation. Operable walls having fewer or even more panel pairs than shown may employ the present invention.

Wall panel 11 is linked to panel 12, panel 13 is linked to panel 14, and panel 15 is linked to panel 16, by multiple hinges 18 arranged along the panel height. Paired panels 11 and 12 are shown in a stacked or folded arrangement with the panel width oriented transverse to track 20, panels 13 and 14 are shown in a partially unfolded arrangement assumed as the panels are pulled along track 20 from a stacked position toward a wall-forming position. Panels 15 and 16 are shown in an extended or unfolded arrangement as they are moved to a wall-forming location along the length of track 20. As referenced with respect to panel 14, each of panels 11–16 generally includes a top edge 26, a bottom edge 28, a vertical leading edge 30 and a vertical trailing edge 32, with leading and trailing used throughout the application in reference to the relative position of various components which occurs when the panels are being moved from a stacked position to an extended position. As also shown in the top view of FIG. 2, each of the panels also includes side facades 34, 36 that, when operable wall 10 is fully extended, are aligned to form exposed wall surfaces in the room areas separated by operable wall 10.

Each of panels 11–16 is suspended from track 20 by an abstractly represented trolley 22. The term trolley is used generally herein and is intended to encompass devices, including wheeled carriages and carriers, of all types that are operably connected to and movable along the track. Track 20 spans fixed walls 38 and 40 and is mounted to a support structure (not shown) above the room to be compartmentalized in a well known fashion. The track parts along which the trolleys 22 ride is located above the ceiling of the room (not shown in FIG. 1). Panels 11–16 may be moved along the track in any known fashion in wall stacking and wall extending directions. The wall panels may be of any conventional design. Furthermore, although shown as being employed with a paired panel system, the anti-stacking systems described herein may be adapted for use with different panel systems, including continuously hinged systems and even single panel systems having a single trolley per panel, and with different or non-straight track layouts.

Figure 2:
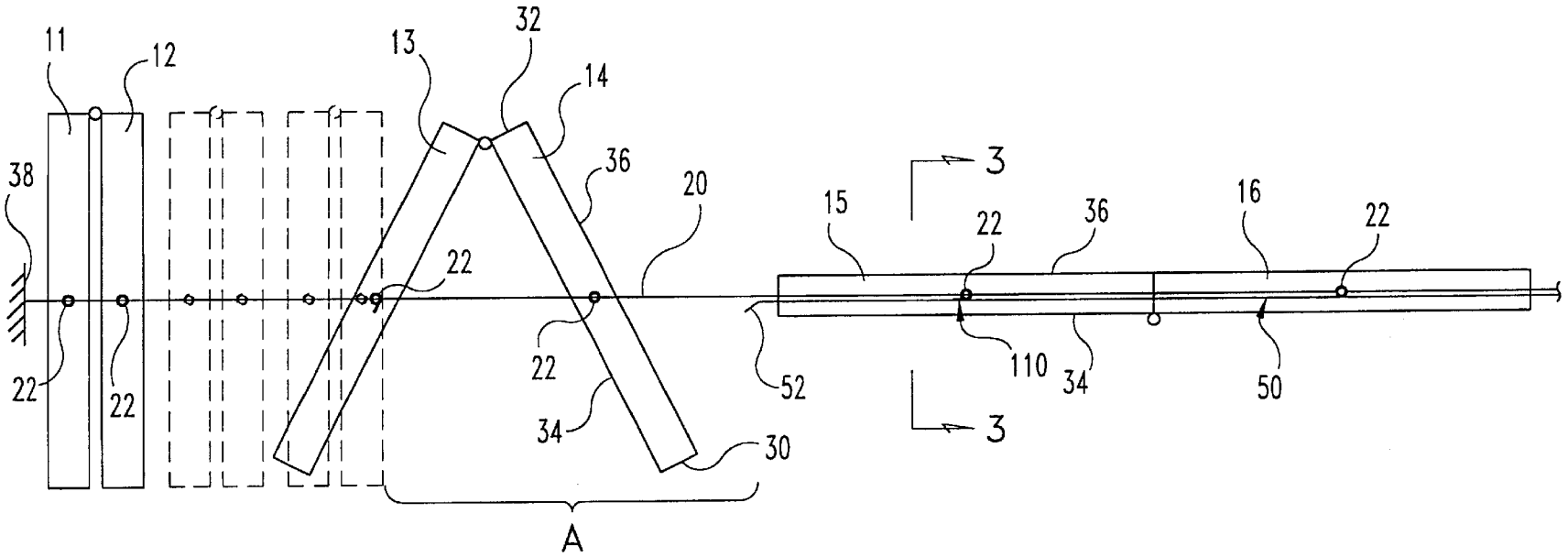
FIG. 2 is a diagrammatic top view of the operable wall of FIG. 1, where the stacked positions of those panels shown being pulled out or extended are also shown in dashed lines.

With reference first to FIG. 2, where track 20 is abstractly represented by its centerline, a first embodiment of an anti-stacking system of the present invention includes a guide rail, generally designated 50. Guide rail 50 is positioned along the wall travel path at any track location at which panel stacking is to be prevented. As panel stacking along the track length is typically only desirable where panel storage occurs, the flared or nose end 52 of guide rail 50 is preferably spaced a predetermined distance A from the stacked position of side facade 36 of leading panel 16, and guide rail 50 continuously extends to abut, or at least be proximate to, wall 40. A suitable dimension for distance A has been found to be at least 50% of the nominal panel width, and is preferably about 100% of the nominal panel width. Thus, for a standard panel width of about four feet, the distance A is typically about four feet. The skilled artisan will also recognize that, in view of the manner in which guide rail 50 is designed to cooperate with panel orienting members disposed on the trolleys of the trail panels of the paired panels as described below, guide rail 50 can terminate short of wall 40 (FIG. 1) by a distance of over a panel width while still serving to prevent panel stacking all the way to wall 40. In addition, other positions of guide rail 50, such as being discontinuous along its length so as to allow panel stacking at intermediate segments of the track length, are within the scope of the invention.

Guide rail 50 is positioned on the side of the centerline of the track and trolleys which is opposite to the side on which are located the hinged connections of the panels in each pair when such paired panels are arranged in a stacked arrangement. This guide rail positioning is responsive to the manner in which the trailing panel trolley-mounted orienting members described below are designed to engage the guide rail 50 to urge the paired panels from a stacked arrangement toward an unfolded arrangement. It will be appreciated that if a paired panel system were to be mounted such that only some of the panel pairs break open into a folded arrangement in a direction facing down in FIG. 2, such as shown with respect to panels 13 and 14, while other panels were mounted so as to break open during unfolding toward a direction facing to the top of that figure, then an additional guide rail with a flared end would be mounted to the track on the track side opposite to guide rail 50. In this instance the panel orienting members described further below for the trail panels of such other panel pairs would also be arranged on the opposite side from which it is shown at 110.

Figure 3:
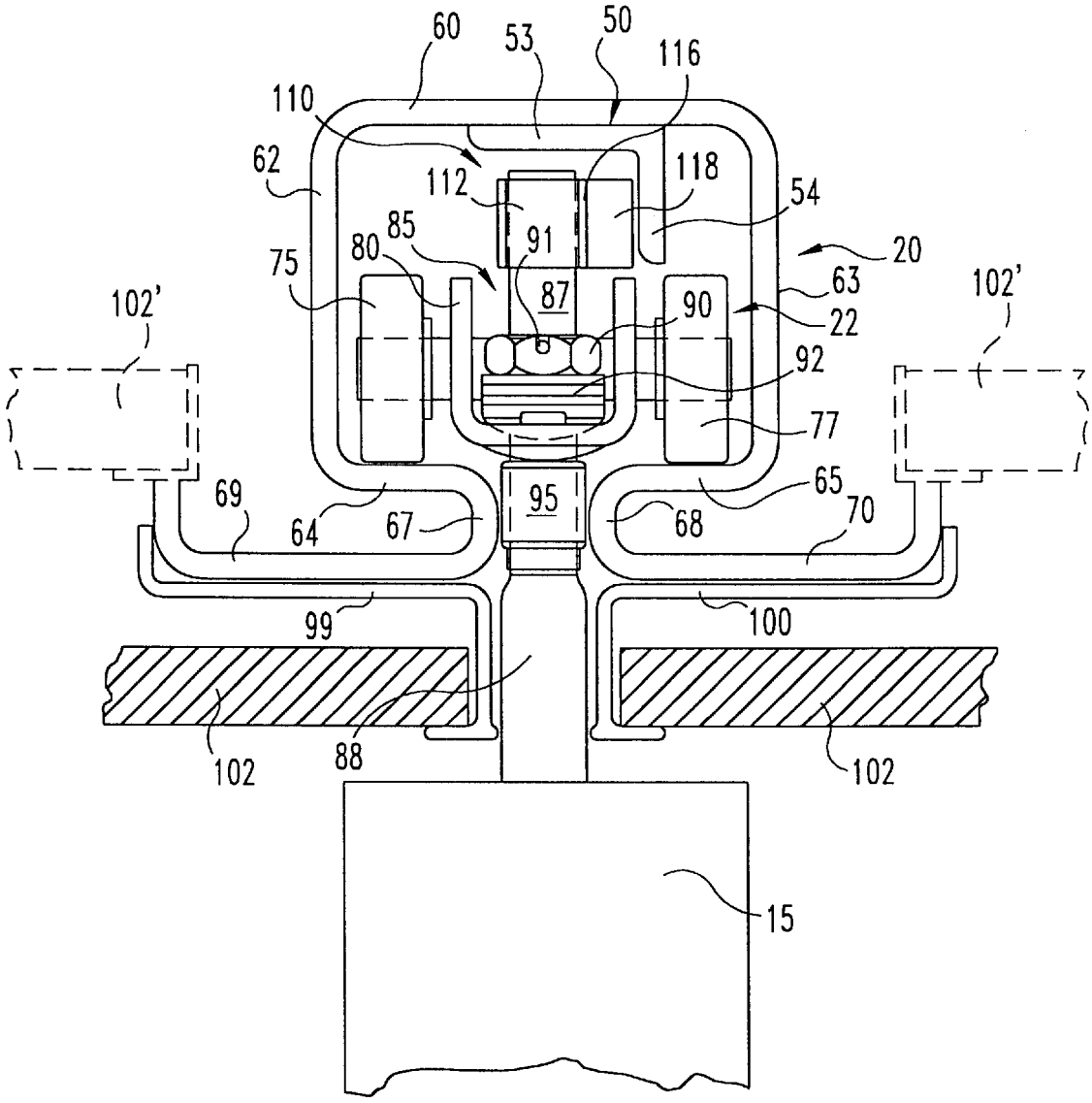
FIG. 3 is a fragmentary, enlarged cross-sectional view, taken along line 3—3 of FIG. 2, as viewed in the direction of the arrow, further illustrating a first embodiment of an anti-stacking system of the present invention in use.

With additional reference to the cross-sectional view of FIG. 3, guide rail 50 is installed to and positioned within the interior of the tube that forms track 20. Depending on certain factors, such as the configuration of the element that forms the trolley track, guide rail 50 alternatively may be installed for operative engagement by a trolley mounted part by being mounted to different portions of the track, or to other operable wall components, such as the hanger brackets, or to the structural support itself.

In the illustrated embodiment, guide rail 50 is formed of a right-angled steel bar with a base flange 53 and a downwardly depending guide flange 54. The bar is most preferably formed of steel. Guide rail flared end 52 (see FIG. 6A) is manufactured by bending outward a section of guide flange 54 at an angle. The length and angle of the guide flange is a function of the size and configuration of the panel orienting member, and particularly the rub knob 118 described below. For most applications, the guide flange 54 will have about a two to six inch length section bent out at an angle of approximately 20 to 30 degrees. One or more braces (not shown) may be connected between the track and flared end 52 if forces sufficient to otherwise bend the guide rail flared end are likely to be experienced. Guide rail flared end 52 may alternatively be provided in the form of a ramped part, such as a wedge, made of a low friction material, such as Delrin®. As a further alternative, the flared end can include a roller separately attached to the track that leads into the guide flange 54.

Guide rail 50 is attached to track 20 via fasteners, such as screws, that extend upwardly through flange 53 and insert into track wall 60. In an alternate embodiment, the guide rail 50 may be integrally formed with the track, such as if the track is made in an extrusion process out of material such as aluminum. Guide rail 50 is installed with the inner surface of guide flange 54 a pre-determined distance (most preferably about ⅝ inch) from the centerline of trolley 22 for the panel orienting member.

The track shape with which guide rail 50 is shown employed in FIG. 3 is illustrative but not limiting, as different track shapes may be used within the scope of the invention. The track 20 is of a known design and is made of hardened hot-rolled steel in a generally square tubular shape including a top wall 60, vertical side walls 62 and 63, and bottom wall portions 64 and 65. The inward facing regions of bottom wall portions 64 and 65 are integrally formed with bend sections 67, 68, respectively, that are horizontally spaced to provide a slot or gap through which the trolley bolt extends, as described further below. The lower ends of bend sections 67, 68 are integrally formed with laterally extending, horizontal flanges 69, 70, respectively. Track 20 may be mounted to the ceiling support structure by any means known in the art, such as by hanger brackets positioned at spaced intervals along the length of the track.

The wheels of trolley 22 roll along the upper surfaces of bottom wall portions 64 and 65 when the wall panel is moved. The trolley design described herein is illustrative but not limiting, as different trolleys may be employed within the scope of the invention as long as a trolley bolt type element is included which operatively mounts a panel orienting member and which is rotationally fixed relative to the panel as further described below.

Trolley 22 includes a pair of wheels 75 that roll along track portion 64 and a pair of wheels 77 that roll along track portion 65. Wheels 75 and 77 are rotatably mounted via partially shown axles on a U-shaped base plate 80 with a central bore through which rotatably extends a trolley bolt, generally designated 85.

Trolley bolt 85 is formed by a steel rod including an upper portion 87 having an outside diameter of about 0.5 inch and which increases in thickness to a lower portion 88 having a 0.75 inch outer diameter. Nut 90 screws onto a threaded section of rod upper portion 87, and pin 91 that inserts into a transverse bore through upper portion 87 and prevents nut 90 from rotating and moving up the height of the rod. Rod upper portion 87 extends through a thrust bearing assembly 92, which comprises a pivot washer as well as a thrust bearing sandwiched between two thrust races, that is sandwiched between the underside of nut 90 and the upper surface of base plate 80. Thrust bearing assembly 92 permits relative rotation of trolley bolt 85 to base plate 80. A pair of rotatable guide wheel assemblies 95 are mounted to the underside of plate 80 so as to flank trolley bolt 85 on its leading and trailing sides, and serve to rollingly engage track bend sections 67, 68 in a low friction manner during trolley movement.

The rod lower portion 88 extends downward between ceiling mounting brackets 99, 100 that are mounted to track flanges 69 and 70 and which support the edges of ceiling tiles 102. This shown ceiling tile mounting is illustrative and not limiting, as the ceiling may be mounted to the track in other locations. For example, brackets 99 and 100 and the suspended ceiling tiles 102 may be eliminated if the ceiling tile as shown in dashed lines at 102' is seated on the upturned outward edges of track flanges 69 and 70. The threaded bottom end of rod lower portion 88 is fixedly attached to the top of abstractly shown wall panel 15 such that trolley bolt 85 does not rotate relative to panel 85. The method of attachment of trolley bolt 85 to panel 15 is not shown in FIG. 3 as it may be of any type known in the art that may be used to lock trolley bolt 85 in place rotationally at a selected orientation, whereby panel 15 and trolley bolt 85 rotate together.

Figure 4:
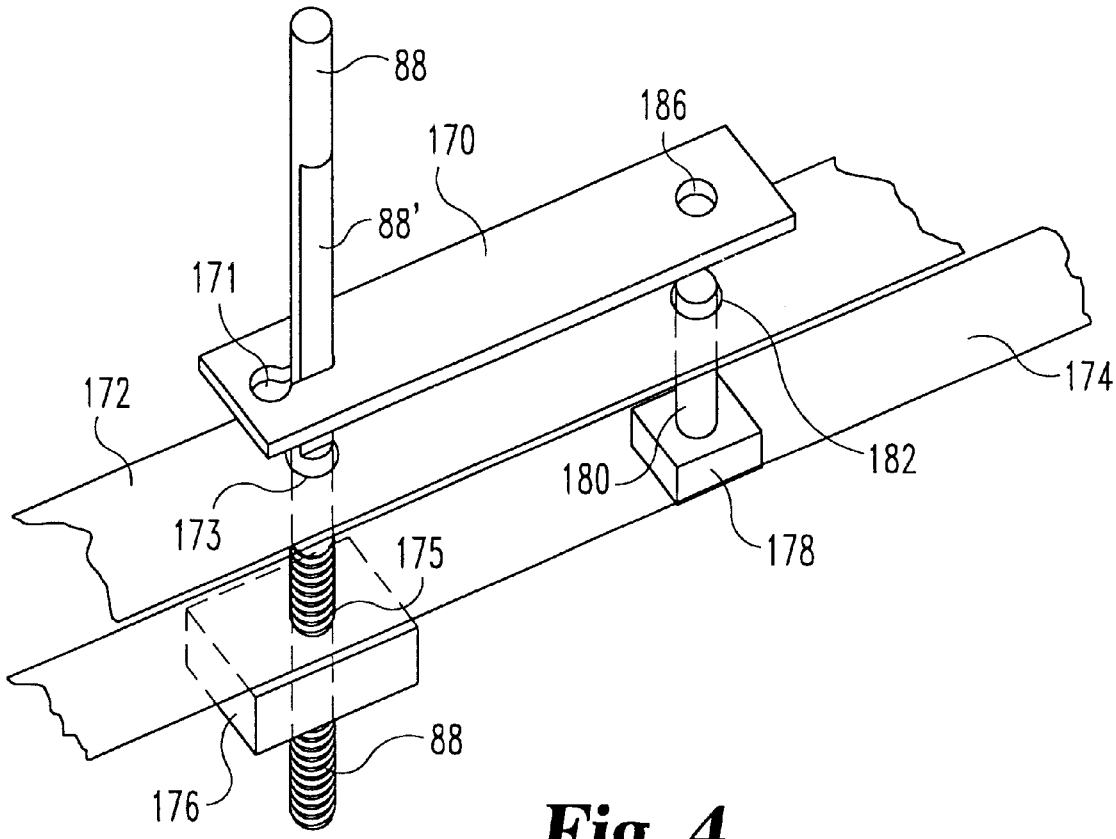
FIG. 4 is a diagrammatic, fragmentary perspective view of one embodiment of components that may be used to attach a trolley bolt to an operable wall panel in a rotationally fixed manner.

FIG. 4 diagrammatically represents one suitable configuration of the components that may be used to attach rod portion 88 to a wall panel. In FIG. 4, rod portion 88 is shown downwardly 171 extending through a keyed opening 171 in wrench 170, an opening 173 in the acoustical sweep retainer plate 172 installed on the top end of the wall panel, and an opening 175 through the horizontal, top frame member 174 of the panel. The wrench keyed opening 171 is shown as a slot that opens into a larger diameter circular opening used for wrench insertion onto the bolt. Steel block 176 is preferably welded to the underside of frame member 174 and includes an internally threaded bore that engages the threaded end of rod portion 88. A wrench locking assembly includes a base block 178, which is welded or fastened to the upper surface of frame member 174, and a locking pin 180 that is fixedly attached to block 178 and which vertically extends upward through an opening 182 in sweep retainer plate 172. Wrench 170 has a keyed opening 171 that conforms to the flats 88' located at diametrically opposed sections of rod portion 88. When wrench 170 is in the orientation of FIG. 4 spaced from retainer plate 172, wrench 170 can be rotated 360°, thereby causing the trolley bolt to rotate to adjust the height to which rod portion 88 inserts into the panel. When the trolley bolt has been properly inserted, wrench 170 can be lowered down onto retainer plate 172 so the upper tip of locking pin 180 inserts through hole 186 in wrench 170, thereby preventing any further rotation of the wrench. Due to this engagement of pin 180 with wrench 170, and due to the fact that the trolley bolt 88 cannot rotate without wrench 170 being rotated, trolley bolt 88 is effectively rotationally locked in place rotationally relative to the panel.

Figure 5A:
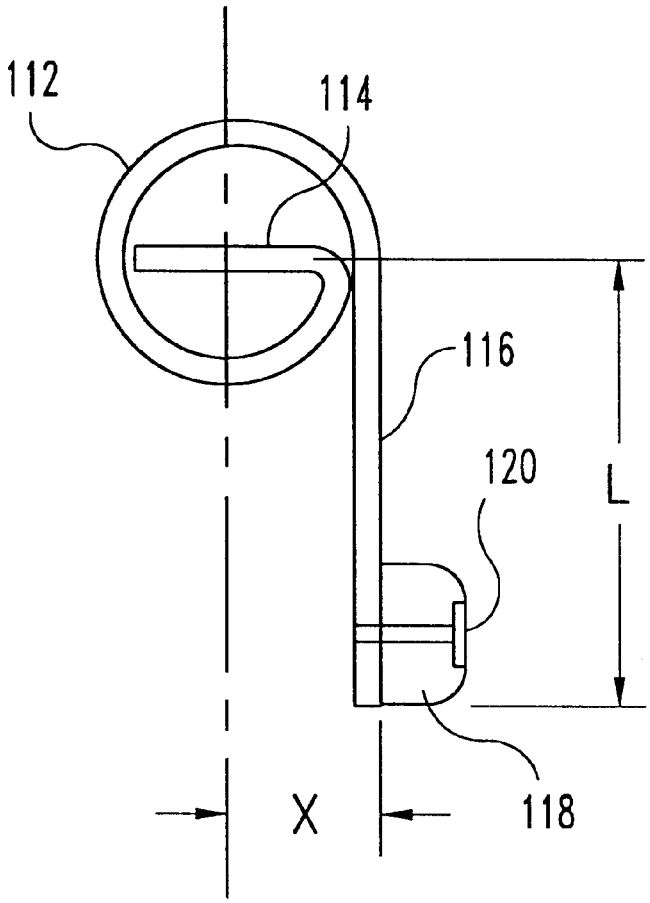
FIG. 5A is a top elevational view of a first embodiment of a panel orienting member of the present invention shown removed from the remainder of the device.
Figure 5B:
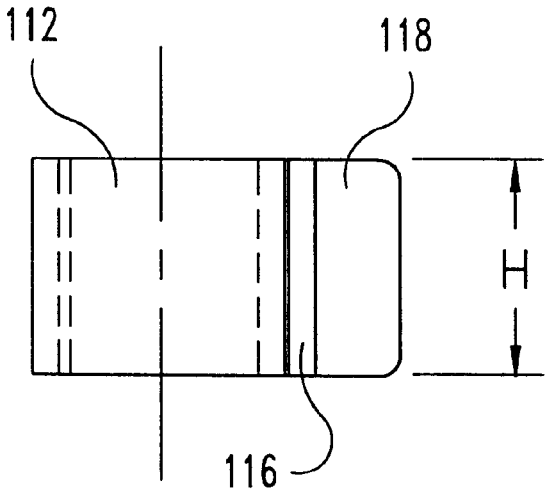
FIG. 5B is an end elevational view of the panel orienting member of FIG. 5A.

Mounted to the top end of trolley bolt 85 is a panel orienting member, generally designated 110 (FIG. 2). In the illustrated embodiment shown panel orienting members 110 are only provided on the trolleys of the trailing panels of each pair which will reach the guide rail 50 when extended. In the preferred form shown in FIG. 3, orienting member 110 includes a leaf spring attached at the top of rod upper portion 87. As further shown in the top and end views, respectively, of FIGS. 5A and 5B, the leaf spring is made of a strip of spring steel having a height H preferably between about 9/16 and ¾ inch. The leaf spring is formed with a circular bent section 112 preferably having an inside diameter of approximately 0.54 inch so as to fit around a 0.5 inch diameter rod upper portion 87. Although shown as being a single or 360° wrapping, circular section 112 may be made with two or more wrappings. The inner tip 114 of the leaf spring extends diametrically within circular section 112 and inserts in an interference fit within a diametric slot formed in the top end of rod upper portion 87 so as to preclude rotation of circular section 112 around the trolley rod. The cantilevered biasing arm 116 of the leaf spring extends tangentially from circular section 112 and has a length L and a spacing X designed in conjunction with the dimension of guide rail 50 and its nose end 52 (FIG. 2). In the preferred embodiment, biasing arm 116 has a length L of about 1.260 inches, and a spacing X of between about 0.4 and 0.8 inch, most preferably about 0.5 inch. The leaf spring is designed such that an angular displacement of biasing arm 116 of about twenty degrees from the unbiased position shown in FIG. 5A results in a 200 to 300 pound returning force being generated by the arm 116.

To limit wear of the leaf spring, a knob 118 is mounted with a fastener 120, such as a rivet with a countersunk head, to the outward facing surface of the outer tip of biasing arm 116. Knob 118 is made out of a durable material, such as nylon or steel, and with rounded corners on its outward face. Knob 118 can be eliminated in alternate embodiments, and further may be substituted with an outwardly looped end of biasing arm 116.

The structure of the anti-stacking system described above will be further understood in view of the following description of its installation and operation. Such description is with reference to FIG. 6, which is a diagrammatic top view showing guide rail 50 in shadow removed from the remainder of the track. Panel orienting member 110 is shown in solid lines in FIG. 6 at rotational positions 110' and 110". The rotational position of the panel corresponding to each of these panel orienting member positions is shown in dashed lines.

During installation, trolley bolt 85 with orienting member 110 attached at its top end is attached in a rotationally fixed manner to panel 15 such that leaf spring biasing arm 116 extends toward the trailing end and parallel to the panel width, or, in other words, parallel to side facades 34 and 36 (FIG. 2).

During wall operation, when the panel is in a stacked or folded arrangement such as partially shown in dashed lines at 15', the panel orienting member is oriented as shown at 110'. As the trolley, and therefore the stacked panel 15' suspended therefrom, moves to the right in FIG. 6 toward guide rail 50, orienting member 110', and more particularly knob 118, abuts the inward facing surface of guide rail flared end 52. As panel 15' continues to be moved to the right, the resistance to bending of biasing arm 116, and the inability of trolley 22 to be moved transversely in the track causes orienting member 110' and trolley bolt 85 to be rotated relative to the trolley base plate and wheels. Due to the fixed attachment of trolley bolt 85 to panel 15', panel 15' consequently begins to fold down, or rotate in a clockwise direction in FIG. 6, toward an extended arrangement.

As panel 15' continues along the track, and the flared guide rail end 52 continues to engage orienting member 110' to cause further rotation of panel 15', ultimately panel 15' is moved to an extended arrangement which is parallel to the length of the track, and which is the rotational orientation shown at 15" in FIG. 6. At this panel orientation, wear knob 118 is in a slightly spaced-apart relationship with the inside face of guide flange 54. It will be appreciated that any attempt to pivot panel 15" toward a stacked arrangement will cause the leaf spring biasing arm 116 to engage guide flange 54 via knob 118, and the resistance of the leaf spring to bending will translate to a torque on the trolley bolt. This torque allows panel 15" to resist the stacking attempt and urges panel 15" to return to its extended arrangement.

Figure 6A:
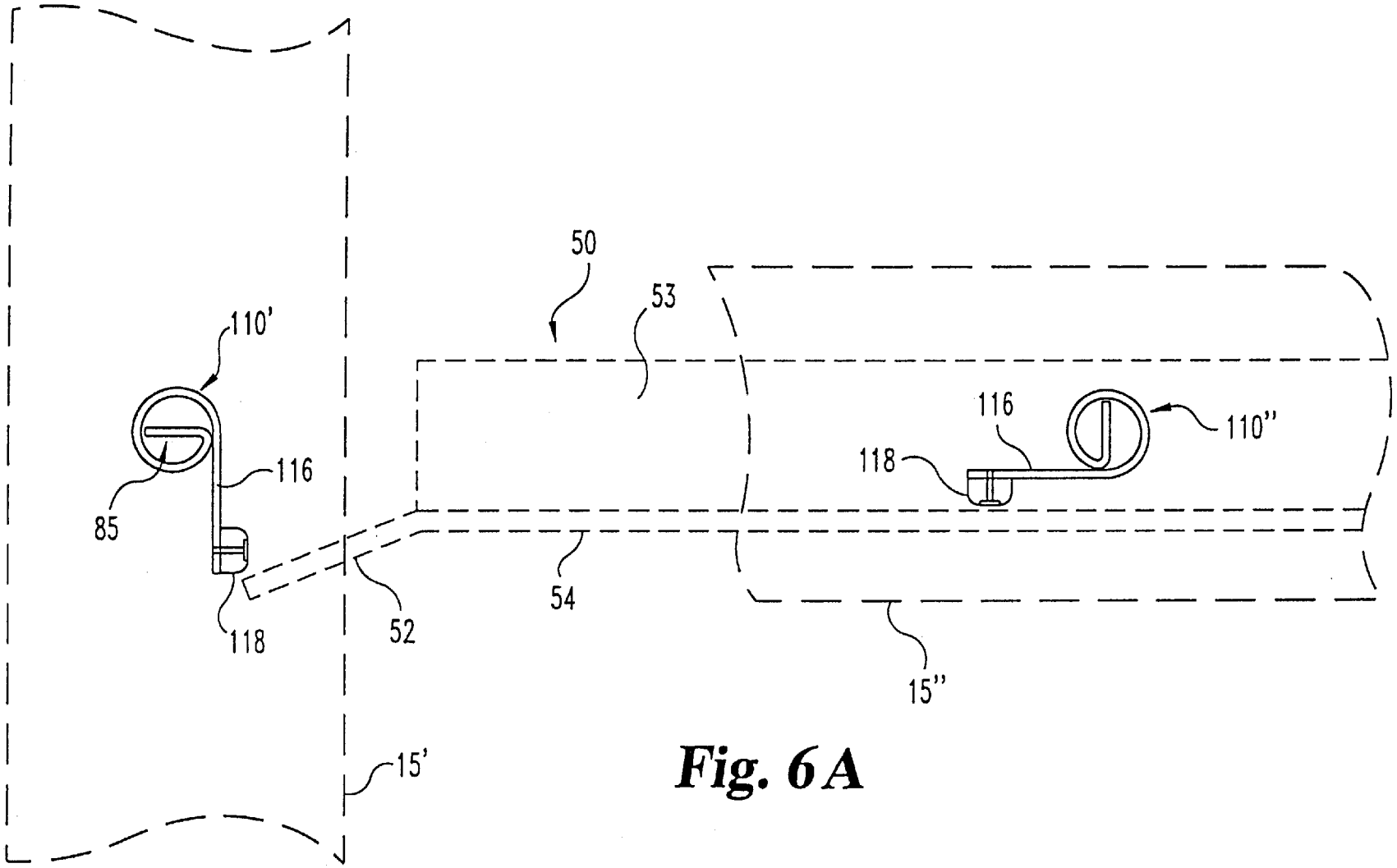
FIG. 6A is a diagrammatic top view of the trail end segment of the guide rail shown in dashed lines, and wherein a panel orienting member of a panel shown partially in dashed lines is illustrated at two stages of panel movement along the track.
Figure 6B:
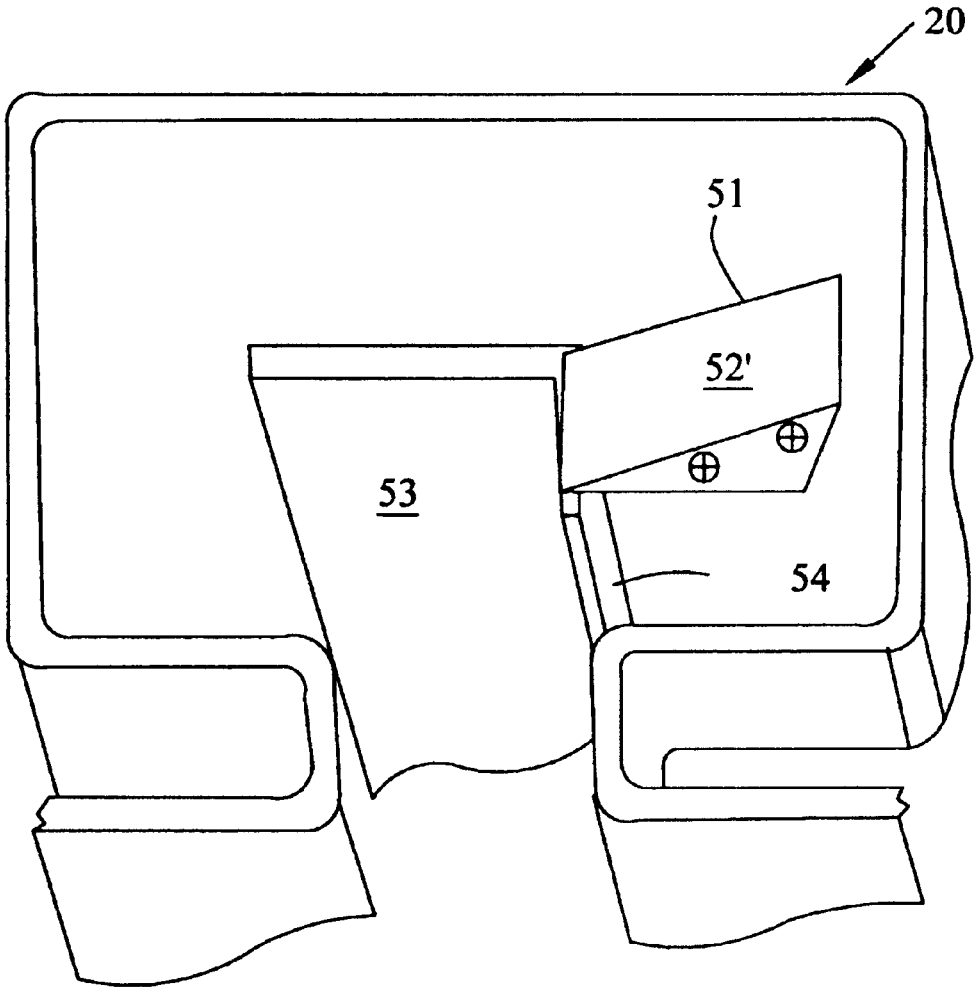
FIG. 6B is an enlarged front perspective view of a trolley track including a wedge to provide a ramp to the guide rail according to one embodiment of the invention.

In another embodiment, the flared end 52 in FIG. 6A can be replaced by the wedge 51 in FIG. 6B. In FIG. 6B, the trolley and orienting member is removed. Wedge 51 includes a ramped part 52' that leads the biasing arm into engagement with guide flange 54.

Figure 7:
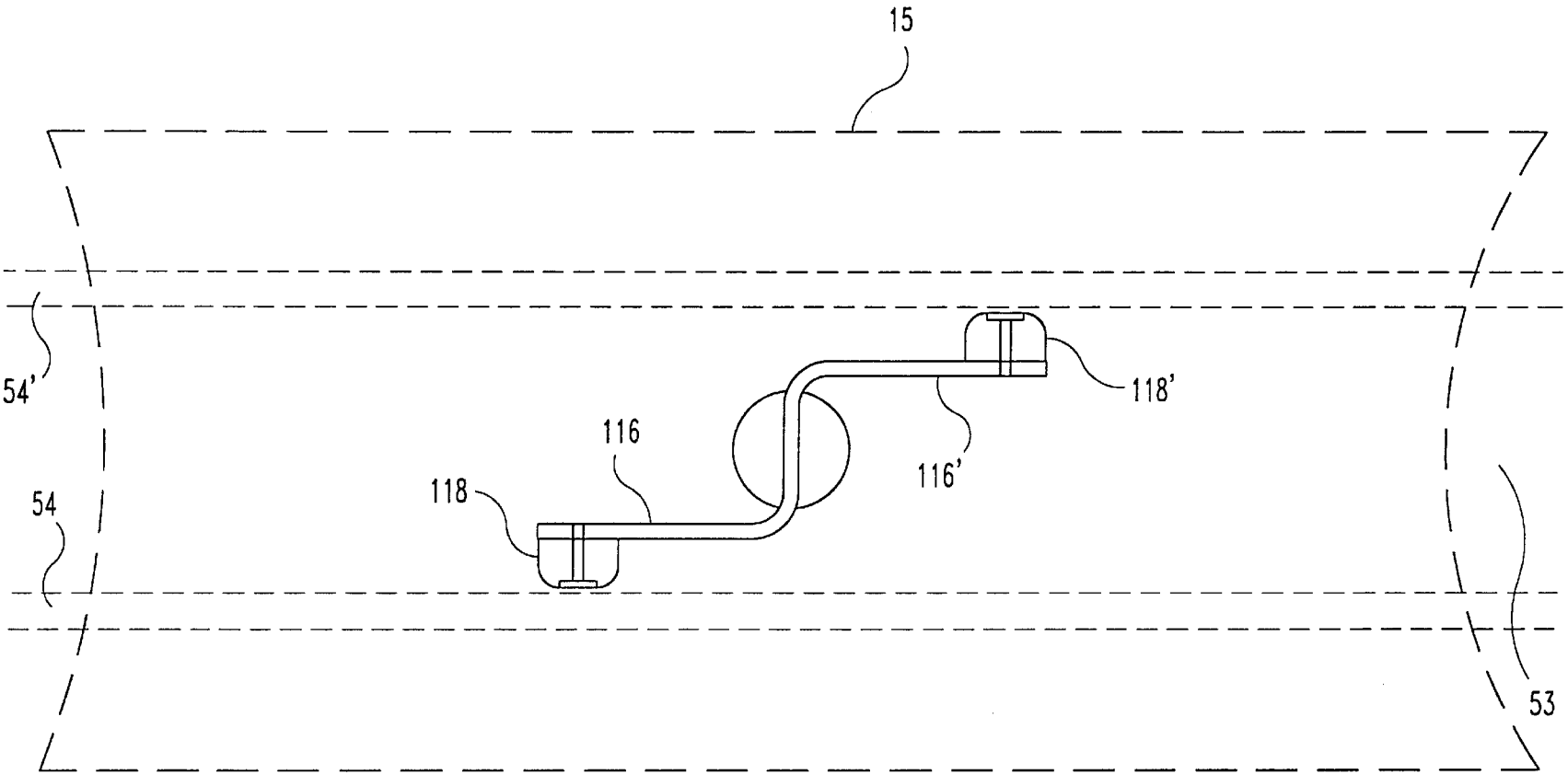
FIG. 7 is a diagrammatic top view of another embodiment of a panel orienting member of the present invention mounted on a panel abstractly shown partially in dashed lines, wherein the panel orienting member is shown between guide rails shown in dashed lines.

In an alternate embodiment of the present invention, the panel orienting member 110 mounted on the trail panel trolley may be provided with leaf spring elements that extend both in a forward and rearward direction from the trolley bolt. Such a configuration, which is diagrammatically shown in the top view of FIG. 7, requires a second guide rail 54' on the opposite side of the track center line. The opposite guide rail 54' engages the forward leaf spring assembly 116' and knob 118'. Leaf spring assembly 116' and guide rail 54' are not utilized to initially bias the panel from a stacked arrangement to an extended arrangement as the panel is moved from a stacked position toward a wall-forming position. Instead the forward leaf spring 116' provides a resisting torque movement of that panel, from an extended arrangement toward a stacking arrangement.

Figure 8:
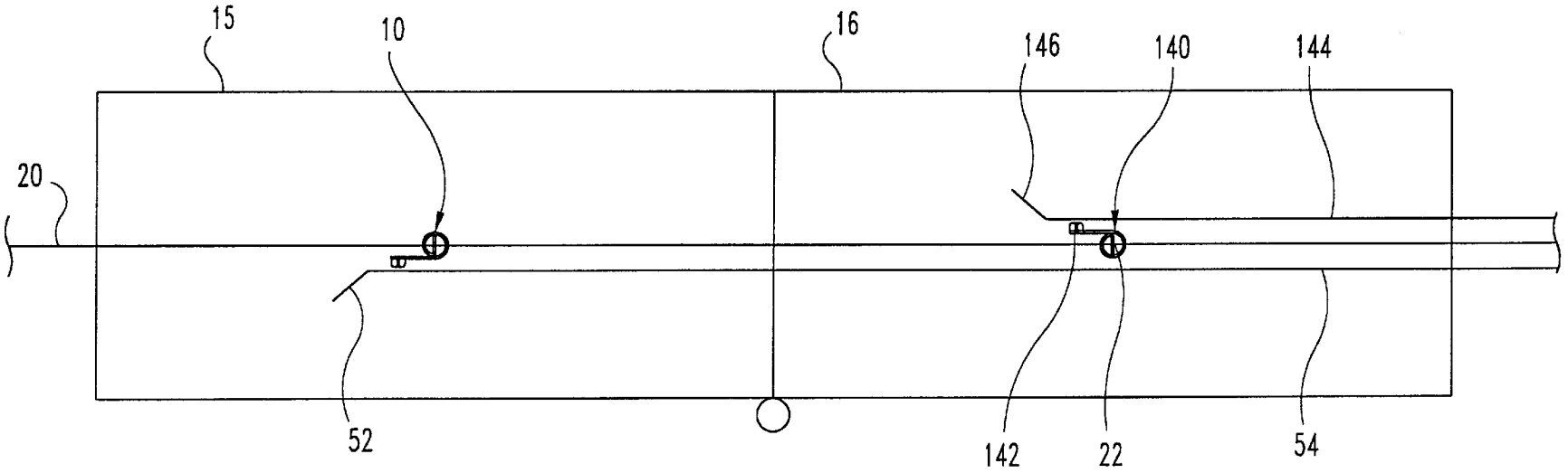
FIG. 8 is a diagrammatic top view of portions of an alternate embodiment of an anti-stacking system of the present invention.

In still another alternate embodiment of the anti-stacking system of the present invention shown abstractly in FIG. 8, both the trolley of the leading panel 16 and the trolley of the trailing panel 15 in a paired panel system are equipped with panel orienting members. As with the embodiment of FIG. 2, a panel orienting member 110 is installed on the trolley of trailing panel 15 as described above. In addition, a similarly configured panel orienting member 140 can be installed on trolley 22 of leading panel 16. Orienting member 140 includes a leaf spring biasing arm 142 that extends toward the trail end of panel 16, but extends off the opposite side of the trolley bolt as orienting member 110. The guide rail includes an additional depending guide flange 144 on the opposite side of the trolley bolt and track centerline as guide flange 54. This may be provided by making the guide rail out of an inverted U-shaped channel member, with the depending legs of the channel member forming guide flange 144 and guide flange 54. The flared end 146 of guide flange 144 is positioned along the track length about one panel width from guide rail flared end 52, so as to engage orienting member 140 of panel 16 when orienting member 110 of panel 15 is engaged by guide rail flared end 52. Because both panel orienting members serve to resist stacking in this embodiment, lighter weight leaf springs may be used than in the embodiment of FIG. 2 in which a single panel orienting member per panel pair is used.

Figure 9:
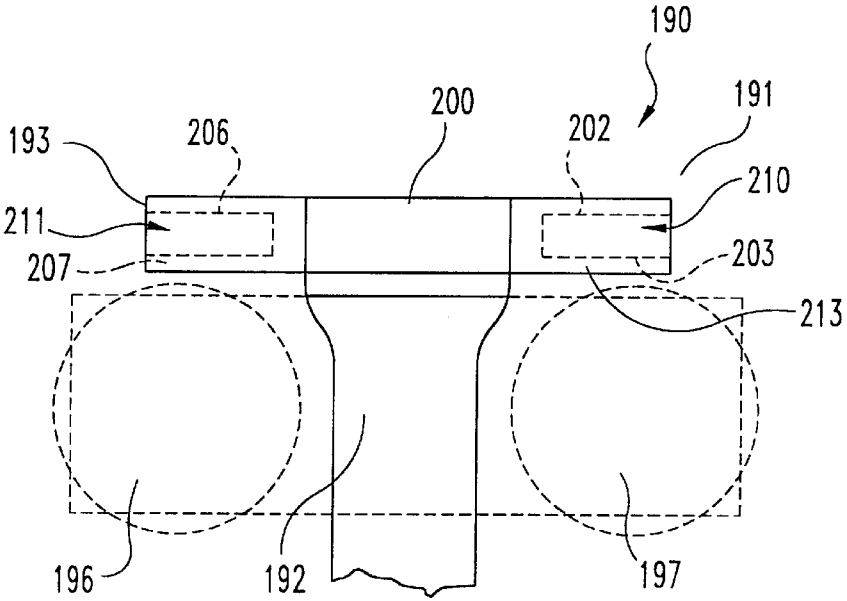
FIG. 9 is a side view of an alternate embodiment of a panel orienting member of the anti-stacking system of the present invention.
Figure 10:
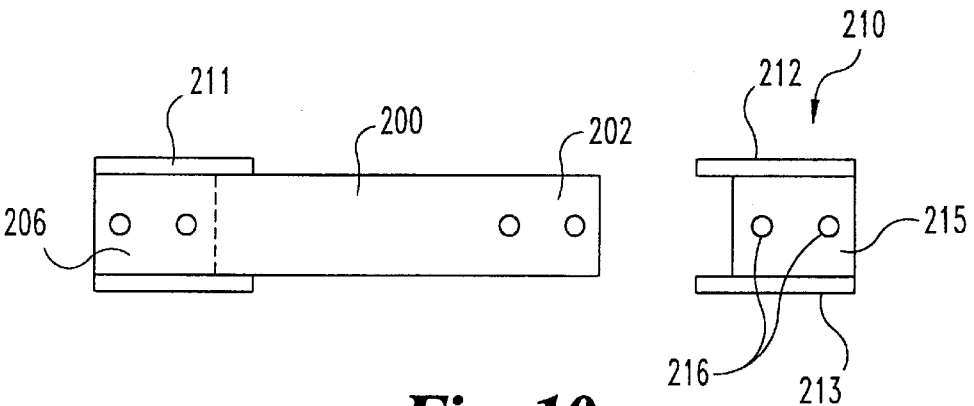
FIG. 10 is a top view of the panel orienting member of FIG. 9 in a partially exploded view, wherein one of the guide rail engaging inserts is shown prior to its securement to the trolley bolt-mounted base.

Referring now to FIGS. 9 and 10, there is diagrammatically shown an alternate embodiment of a panel orienting member of the present invention. FIG. 9 shows a panel orienting member, generally designated 190, that is mounted to the top of a partially shown trolley bolt 192. Bolt 192 is rotatably mounted via a conventional thrust bearing assembly (not shown) to a trolley (abstractly shown in dashed lines), which trolley includes wheels 196, 197 that ride along the track. Bolt 192 extends downwardly to a wall panel and is attached thereto in a rotationally fixed manner in a conventional fashion.

Unlike panel orienting member 110 of the embodiment of FIG. 3 which transversely extends from the trolley bolt in a single direction, panel orienting member 190 transversely projects from the trolley bolt in two directions at 191 and 193. This design allows the trolley bolt to be attached to the panel at either of two rotational positions relative to the panel, which rotational positions are spaced 180° apart.

Panel orienting member 190 includes a center portion 200, preferably made of steel and welded to the top of bolt 192. Center portion 200 can include a pair of vertically spaced plate sections 202 and 203 that project in one direction, and a similar pair of vertically spaced plate sections 206 and 207 that project in the opposite direction.

In order to extend the life of panel mounting member 190, the portions thereof that rub against the guide rails during use are provided in the form of replaceable inserts, preferably made of a wear resistant and low friction material. Inserts 210 and 211 are mounted on the opposite ends 191 and 193 of member 190. As inserts 210 and 211 are similar in design, the following explanation of insert 210 will be appreciated as having equal application to insert 211.

With additional reference to FIG. 10, insert 210 includes side flanges 212 and 213 that flank and extend the full height of plate sections 202 and 203. Insert 210 includes a central plate 215 that spans flanges 212 and 213 and which inserts within the vertical space between base plate sections 202 and 203. Fasteners can be inserted through aligned holes in plate sections 202 and 203 and holes 216 in the plate 215 in order to mount the insert. A preferred material for the insert is Delrin®, but other types of materials, such as a Teflon®, may be employed.

The panel orienting member extends at 191 and 193 in two directions from the trolley bolt. With this embodiment guide rails are disposed on either side of the trolley such as in the form of an inverted U-shaped channel. While only one of the extending portions 191 and 193 is designed to engage a guide rail flared end during panel flattening, both extending portions 191 and 193 engage the guide rails to provide a return force that resists attempts to rotate a panel from a wall-forming position toward a stacking arrangement.

Figure 11:
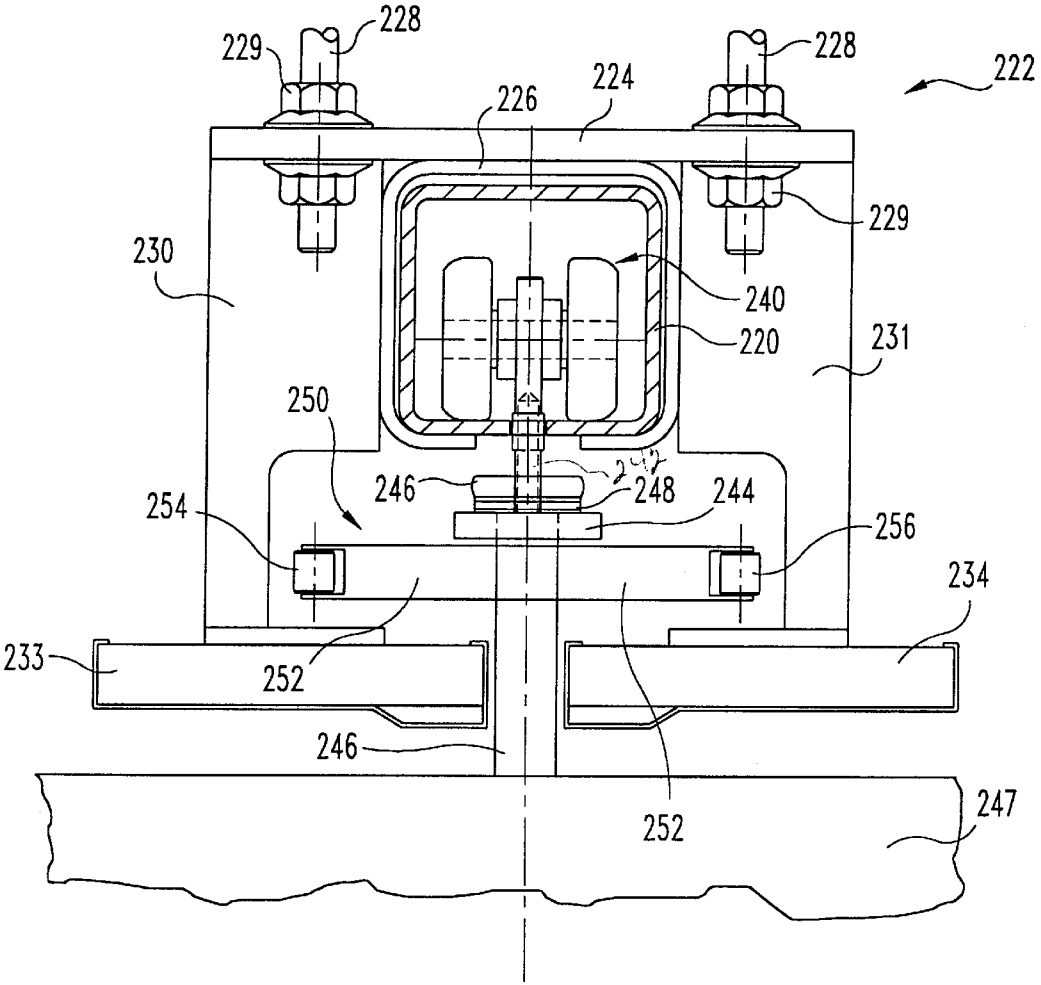
FIG. 11 is a fragmentary, cross-sectional view illustrating still another alternate embodiment of an anti-stacking system of the present invention, wherein the view is taken along a section of the track where the panel is still in a stacked arrangement.
Figure 12:
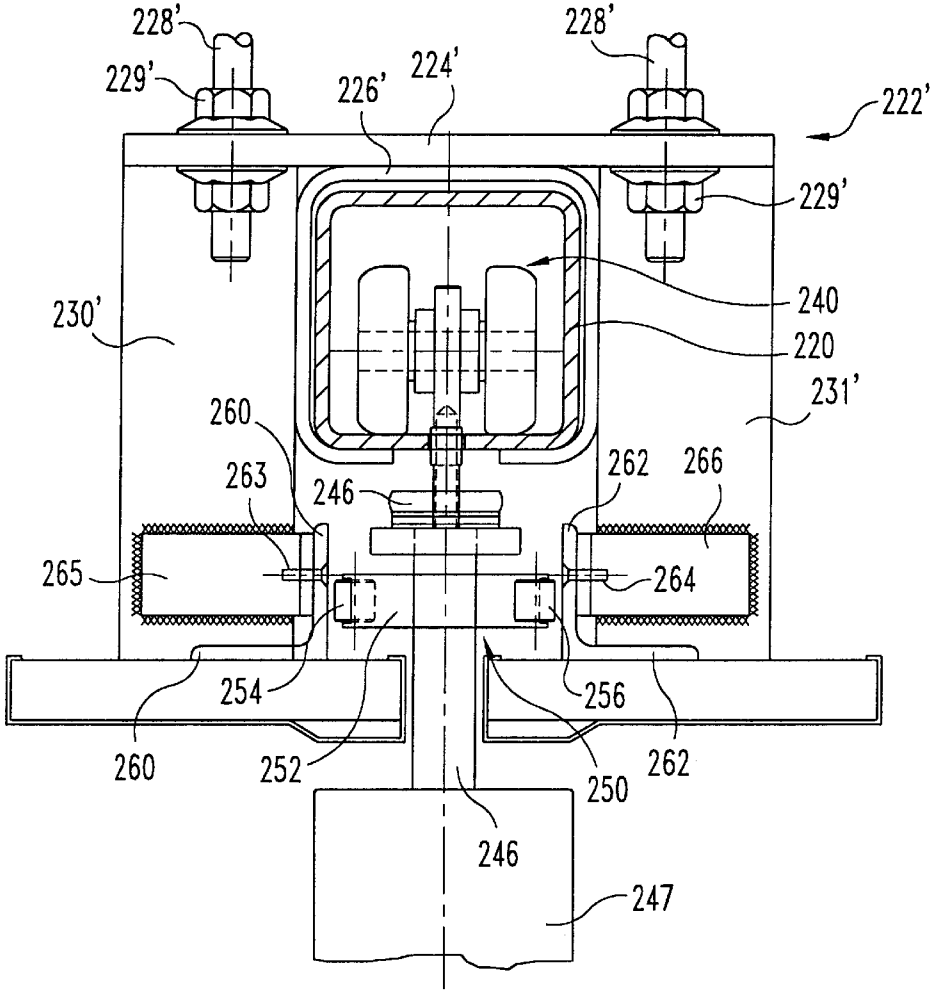
FIG. 12 is a fragmentary, cross-sectional view of the anti-stacking system of FIG. 11 at a different location of the track at which guide rails have engaged the panel orienting member so as to cause the panel to be arranged in a wall-forming arrangement.

Referring now to FIGS. 11 and 12, there is shown an alternate embodiment of the present invention. With reference to FIG. 11, which is a view of the invention taken at a section of the track along which panel stacking is permitted and which therefore lacks guide rails as described below, track 220 is shown mounted to a hanger bracket, generally designated 222, which includes a top bar 224 to which is welded a channel segment 226 that supportedly extends under track 220. Top bar 224 uses a pair of hanger rods 228 and associated securing nuts 229 to mount the hanger bracket to the support structure in a conventional fashion. Hanger bracket 222 also includes soffit suspending plates 230, 231 that are connected to top bar 224 at their top ends and to soffit portions 233, 234 that run the track length at their other ends.

The trolley is diagrammatically shown at 240 and includes a depending plate 242 which is fixedly secured to a horizontal support plate 244. A thrust bearing assembly 248 around trolley bolt 246 allows that trolley bolt to rotate relative to the support plate 244, and the lower end of trolley bolt 246 is attached in a rotationally fixed manner to the upper end of a panel 247 which is arranged in a stacked arrangement with its width perpendicular to the track length.

Mounted to trolley bolt 246 is a panel orienting member, generally designated 250. Panel orienting member 250 includes a horizontally extending bar 252 which is attached to trolley bolt 246 so as not to be rotatable therearound. Rollers 254 and 256 are rotatably mounted on not shown axles at the opposite ends of bar 252. Bar 252 is mounted so as to be not parallel to, or in other words angled relative to, the panel width, such that roller 254 is closer to the viewer of FIG. 11 than is roller 256. This bar angling is a function of the bar length, and is selected such that when the panel is arranged in line with the track in a wall-forming arrangement as shown in FIG. 12, the rollers 254 and 256 are each in close proximity to different guide rails positioned on either side of the track centerline.

In FIG. 12, there is shown a view of the invention taken at a section of the track along which panel 247 is in a wall-forming arrangement and in which the panel is prevented from stacking due to the presence of guide rails 260 and 262 that are provided in the form of L-shaped beams. Although the hanger bracket 222' is a different bracket than bracket 222 shown in FIG. 11, such brackets are identical in design other than for cut outs on the soffit suspending plates, and therefore corresponding parts are referenced with a prime notation. Guide rail 260 is secured with screw 263 or other suitable fasteners to L-shaped bracket 265 welded to soffit suspending plate 230' at a height below the track, but above the soffit and therefore the ceiling of the room in which the system is installed. Guide rail 262 is similarly secured with screw 264 to L-shaped bracket 266 welded to soffit suspending plate 231'. The trail end of guide rail 262 is flared and adapted to engage roller 256 to rotate the trolley bolt in a similar manner as described above, in order to properly orient the panel. When panel orienting member 250 is arranged as shown in FIG. 12 between guide rails 260 and 262, moving panel 247 toward a stacking arrangement is prevented by the engagement of rollers 254 and 256 with guide rails 260 and 262, respectively.

While the invention has been illustrated and described in detail in the drawings and foregoing description, the same is to be considered as illustrative and not restrictive in character. It should be understood that only the preferred embodiments have been shown and described and that all changes and modifications that come within the spirit of the invention are desired to be protected.

For example, panel orienting members could be mounted only on the trolleys of the lead panels in a paired panel system. This application is therefore intended to cover any variations, uses or adaptations of the invention using its general principles. Further, this application is intended to cover such departures from the present disclosure as come within known or customary practice in the art to which this invention pertains.

What is claimed is:

1. In a wall panel system having wall panels suspended from a trolley bolt of a track and trolley system and rotatable between a wall arrangement position and a stacking position to allow stacking of the panels when moved to a track section for storage of the wall panels, an anti-stacking mechanism to prevent stacking of the wall panels at other than the storage area, said anti-stacking mechanism comprising:

at least one guide rail adjacent the track and extending substantially along a length of the track outside the storage area;

a panel orienting member attached to the trolley bolt supporting a wall panel, said orienting member including at least one biasing arm engaging said at least one guide rail to prevent rotation of the panel to a stacking position at other than the storage section of the track.

2. The anti-stacking mechanism of claim 1 wherein said at least one guide rail includes a base flange and at least one guide flange vertically depending from said hose flange to engage said at least one biasing arm.

3. The anti-stacking mechanism of claim 2 wherein said at least one guide flange has a flared end at an end of said guide flange adjacent the storage area to allow gradual transition of said panels from said wall arrangement position to said stacking position as said panel orienting member contacts said flared end.

4. The anti-stacking mechanism of claim 3 wherein said flared end includes a portion of said guide flange adjacent said storage area bent at an outward angle relative to the track.

5. The anti-stacking mechanism of claim 4 wherein said outward angle is between 20 to 30 degrees relative to said guide flange.

6. The anti-stacking mechanism of claim 4 wherein said portion of said guide flange has a length between 2 and 6 inches.

7. The anti-stacking mechanism of claim 2 further including a wedge mounted at said end of said at least one guide rail adjacent said storage area, said wedge having a ramp to engage said biasing arm to allow gradual transition of said panels from said wall arrangement position to said stacking position.

8. The anti-stacking mechanism of claim 1 wherein said at least one guide rail is mounted on the track.

9. The anti-stacking mechanism of claim 8 wherein said at least one guide rail is integrally formed with the track.

10. The anti-stacking mechanism of claim 1 wherein the trolley bolt has a free end defining a slot and said biasing arm includes a first end section engaging said slot, a circular bent section wrapped around said trolley bolt free end, and a second end section engaging said at least one guide rail to bias the panel in said wall arrangement position.

11. The anti-stacking mechanism of claim 10 wherein said orienting member further includes a wear knob attached to said second end section of said biasing arm to reduce friction with said at least one guide rail.

12. The anti-stacking mechanism of claim 1 wherein the trolley bolt has a free end defining a transverse slot relative to the track and said biasing arm has a center section engaging said slot and first and second end sections bent to extend in opposite directions along the track, each said first and second end sections engaging one of said at least one guide rails to bias said panel in a wall arrangement position.

13. The anti-stacking mechanism of claim 12 wherein said orienting member further includes a wear knob at each of said first and second end sections to reduce friction with said at least one guide rails.

14. The anti-stacking mechanism of claim 1 wherein said biasing arm includes a pair of elongated vertically spaced plates each having a center section fixedly attached to a free end of said trolley bolt and a pair of opposite ends extending in opposite directions parallel to the width of the wall panel, each said opposite ends of said pair of plates defining a slot therebetween.

15. The anti-stacking mechanism of claim 14 wherein said orienting member further includes an insert receivable in each said slot for engagement with said at least one guide rail, said insert being made of a low friction material, and a number of fasteners to removably retain said inserts in said slots.

16. The anti-stacking mechanism of claim 15 wherein said insert includes a central section spanning a pair of flanges, said central section sized for insertion into said slot.

17. The anti-stacking mechanism of claim 1 wherein said biasing arm includes a bar having a center section fixedly attached to said trolley bolt and a pair of opposite ends extending in opposite directions and angled in relation to the wall panel, said bar having a roller rotatably mounted at each said opposite end for engagement with said at least one guide rail.

18. The anti-stacking mechanism of claim 17 wherein said bar has a length sized so that said rollers are in close proximity to said at least one guide rail when the wall panel is in said wall arrangement position.

19. An orienting mechanism for use with a movable wall system, said orienting mechanism comprising:

a trolley bolt attachable to a wall panel;

at least one biasing member attached to said trolley bolt, said at least one biasing member including a spring element;

a wear knob attached to an end of said at least one biasing member.

20. The orienting mechanism of claim 19 wherein said spring element includes a flat leaf spring.

21. The orienting mechanism of claim 20 wherein said leaf spring includes a first end section attached to said trolley bolt, a circular bent section wrapped at least 360 degrees around said first end section, and a second end section to which said wear knob is attached.

22. The orienting mechanism of claim 21 wherein said flat leaf spring is made of metal.

23. The orienting mechanism of claim 22 wherein said metal is steel.

24. The orienting mechanism of claim 23 wherein said circular bent section has an inside diameter of about 0.54 inches.

25. The orienting mechanism of claim 23 wherein said leaf spring has a height of about 9/16 to 3/4 inches.

26. The orienting mechanism of claim 23 wherein said second end section has a length of about 1.26 inches.

27. An orienting mechanism for use with a movable wall system, said orienting mechanism comprising:

a trolley bolt fixedly attachable to an operable wall panel;

a biasing member including a pair of vertically spaced elongated plates each having a center section fixedly attached to a free end of said trolley bolt and a pair of opposite ends extending in opposite directions parallel to the width of the wall panel, each said opposite ends of said pair of plates defining a slot therebetween.

28. The orienting mechanism of claim 27 wherein said biasing member further includes an insert receivable in each said slot for engagement with a guide rail, said insert being made of a low friction material, and a number of fasteners to removably retain said inserts in said slots.

29. The anti-stacking mechanism of claim 28 wherein said insert includes a central section spanning a pair of flanges, said central section sized for insertion into said slots.

30. An orienting mechanism for use with a movable wall system, said orienting mechanism comprising:

a trolley bolt fixedly attachable to an operable wall panel;

a biasing member including a bar having a center section fixedly attached to said trolley bolt and a pair of opposite ends extending in opposite directions and angled in relation to the said panel, said bar having a roller rotatably mounted at each said opposite end for engagement with a guide rail.

31. The orienting mechanism of claim 30 wherein said bar has a length sized so that said rollers are in close proximity to said at least one guide rail when said wall panel is in a wall arrangement position.

32. A mechanism for installing a trolley bolt onto an operable panel in a rotationally fixed relation, said mechanism comprising:

a trolley bolt having a shank portion, said shank portion having at least one flat thereon;

a wrench having a keyed opening at a first end, said keyed opening including a slot sized to engage said at least one flat to turn said trolley bolt and a circular opening having a diameter larger than a diameter of said trolley bolt, and said wrench having a second end, said second end having a hole; and a locking pin mounted on said wall panel and receivable in said hole and disposed so that said hole receives said pin when said wrench is positioned so that said at least one flat is engaged by said slot and said wrench is lowered on to said pin.

* * * * *